United States Patent [19]

Ichikawa et al.

[11] Patent Number: 4,512,297

[45] Date of Patent: Apr. 23, 1985

[54] APPARATUS FOR CONTROLLING ENERGIZATION OF GLOW PLUGS

[75] Inventors: Sadao Ichikawa; Tuyoshi Kamiya, both of Aichi, Japan

[73] Assignees: NGK Spark Plug Co., Ltd.; Nissan Motor Company, Limited, both of Japan

[21] Appl. No.: 530,917

[22] Filed: Sep. 9, 1983

[51] Int. Cl.[3] ..... F02P 19/02

[52] U.S. Cl. ..... 123/179 H; 123/145 A; 123/179 BG; 219/483

[58] Field of Search ..... 123/179 BG, 179 B, 179 H, 123/145 A; 219/483

[56] References Cited

U.S. PATENT DOCUMENTS 4,285,307 8/1981 Steinke ..... 123/179 BG 4,375,205 3/1983 Green ..... 123/179 H

*Primary Examiner*—Andrew M. Dolinar

*Attorney, Agent, or Firm*—Sughrue, Mion, Zinn, Macpeak and Seas

[57] ABSTRACT

An apparatus for controlling energization of quick-heating glow plugs in an internal combustion engine comprises a power supply, a main relay having a normally open contact, a transfer-type changeover terminal having a neutral terminal, a normally closed terminal connected to ground, and a normally open contact connected to the power supply, a plurality of pairs of glow plugs, the glow plugs having one terminals connected through the normally open contact to the power supply, the glow plugs in each pair having one of other terminals grounded and the other terminal connected to the neutral contact, and a control circuit for controlling the main and changeover relays to connect the glow plugs in each pair selectively in series or parallel to each other with respect to the power supply.

4 Claims, 2 Drawing Figures

APPARATUS FOR CONTROLLING ENERGIZATION OF GLOW PLUGS

BACKGROUND OF THE INVENTION

The present invention relates to an apparatus for controlling energization of glow plugs used in starting internal combustion engines such as diesel engines.

For starting an internal combustion engine such as a diesel engine, the glow plugs are preheated by passing an electric current therethrough. It is preferable to preheat the glow plugs in as short a period of time as possible by speeding up the rate of increase of the temperature of the glow plugs. To meet such a demand, there has been proposed to use quick-heating glow plugs and two relays for the control of energization of the glow plugs, as disclosed in Japanese Laid-Open Utility Model Publication No. 56157383. According to the disclosed system, the glow plugs are quickly heated up to a predetermined temperature by a large current supplied from the first relay, and then the glow plugs are supplied with a small surrent from the second relay through a current limiting resistor to keep the temperature of the glow plugs at a desired level.

However, the current limiting resistor causes a wasteful consumption of electric power when the current is supplied from the second relay to the glow plugs. When the glow plugs are frequently used to provide a so-called "afterglow" after the engine has been started, or the glow plugs are energized for a long period of time, the current limiting resistor consumes as much electric power as the glow plugs do. This shortens the service life of the battery used, and is problematic from the standpoint of saving electric energy and natural resources.

Japanese Laid-Open Utility Model Publication No. 54-42827 discloses a glow plug control system free of the foregoing difficulty. This prior control system includes a circuit for controlling an electric current fed to glow plugs, the circuit having relays operable for selectively connecting at least two glow plugs in series with or parallel to each other. The known relay-controlled system is costly to construct since it requires at least four relay contacts to cause the direction of a current flowing through each the glow plugs to remain unchanged before and after the glow plug connection is varied.

SUMMARY OF THE INVENTION

It is an object of the present invention to provide an apparatus for controlling energization of glow plugs which includes a relay having a minimum number of relay contacts for selectively connecting at least two glow plugs in series with or parallel to each other with respect to the power supply and disconnecting the glow plugs, and which is practically advantageous in that it is inexpensive to construct, compact in size, and will operate reliably.

According to the present invention, there is provided an apparatus for controlling energization of quick-heating glow plugs in an internal combustion engine, comprising a power supply, a main relay having a normally open contact, a transfer-type changeover terminal having a neutral terminal, a normally closed terminal connected to ground, and a normally open contact connected to the power supply, a plurality of pairs of glow plugs, the glow plugs having one terminals connected through the normally open contact to the power supply, the glow plugs in each pair having one of other terminals grounded and the other terminal connected to the neutral contact, and a control circuit for controlling the main and changeover relays to connect the glow plugs in each pair selectively in series or parallel to each other with respect to the power supply.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
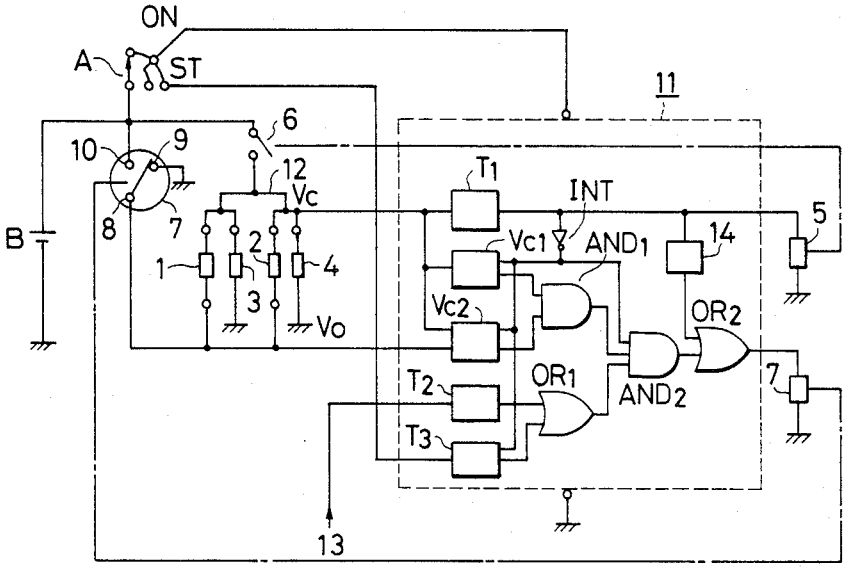
FIG. 1 is a circuit diagram of an apparatus for controlling energization of glow plugs according to the present invention.

As shown in FIG. 1, glow plugs 1, 2 with their terminals insulated and glow plugs 3, 4 with one terminals grounded are mounted in a precombustion chamber in a diesel engine. The glow plugs 3, 4 may have all of their terminals insulated. The glow plugs 1, 3 are connected to each other as one pair, and the glow plugs 2, 4 are interconnected as another pair. These two pairs of glow plugs are coupled with each other through a junction 12 which is connected through a normally open contact 6 of a main relay 5 to a battery B. The terminals of the glow plugs 3, 4 which are remote from the junction 12 are grounded (they are grounded at the same time that they are mounted on the engine). The terminals of the glow plugs 1, 2 which are remote from the junction 12 are connected to a neutral terminal 8 of a transfer relay 7. The transfer relay 7 has a normally closed contact 9 connected to ground and a normally open contact 10 connected to the battery B. A key switch A of the engine has a turn-on switch ON and a start switch ST. The main relay 5 and the transfer relay 7 are controlled by a control circuit 11.

The control circuit 11 includes a preheating timer $T_1$ to which there is applied a glow plug voltage $V_C$ at the junction 12 between the glow plugs 1, 3 and the glow plugs 2, 4 for setting a timer time interval dependent on the voltage Vc. The preheating timer T1 has an output terminal coupled to the main relay 5, which is energized as long as the preheating timer $T_1$ is actuated for closing the normally open contact 6. The control circuit 11 also has voltage comparators $V_{C1}$, $V_{C2}$. The voltage comparator $V_{C1}$ issues a signal of a logic high level when the voltage $V_C$ (hereinafter referred to as a "intermediate junction voltage") at the junction 12 is below a predetermined voltage $V_1$, and issues a signal of a logic low level when the intermediate junction voltage $V_C$ exceeds the predetermined voltage $V_1$. The output from the voltage converter $V_{C1}$ is applied to an AND gate $AND_1$. The voltage comparator $V_{C2}$ issues a signal of a logic high level when the intermediate junction voltage $V_C$ exceeds a voltage $V_2$ having a predetermined ratio with respect to a power supply voltage $V_D$, and issues a signal of a logic low level when the intermediate junction voltage $V_C$ is equal to or below the voltage $V_2$. The output from the voltage converter $V_{C2}$ is applied to the AND gate $AND_1$. An afterglow timer $T_2$ is turned on in response to a signal from an engine regulator L terminal 13 and will be turned off upon elapse of a certain interval of time. An output from the afterglow timer $T_2$ is applied through an OR gate $OR_1$ to an AND gate $AND_2$. A warmth retaining timer $T_3$ is turned on when the preheating timer $T_1$ is turned off, and turned off when the start terminal ST of the key switch is turned off. The AND gate $AND_2$ is supplied with an output from the AND gate $AND_1$, an output from an inverter INT which inverts the output from the preheating timer $T_1$, and the output from the OR gate $OR_1$. The AND gate $AND_2$ is applied through an OR gate $OR_2$ to a changeover relay 7 for energizing or deenergizing the same. To the output terminal of the preheating timer $T_1$, there is coupled a delay pulse generator 14 for issuing a signal of a logic high level for a short interval of time upon elapse of a predetermined short period of time after the preheating timer $T_1$ has been turned off. An output from the delay pulse generator 14 is applied through the OR gate $OR_2$ to the changeover relay 7 for actuating the latter.

Accordingly, the main relay 5 is energized for a period of time $t_1$ in which time the preheating timer $T_1$ is turned on. The changeover relay 7 is energized for a period of time in which the main relay 5 remains inactivated and the delay pulse generator 1 is kept turned on, or for a period of time in which the main relay 5 remains inactivated, the intermediate junction voltage $V_C$ falls within a prescribed voltage range, and the afterglow timer $T_2$ or the warmth retaining timer $T_3$ is turned on.

Operation of the apparatus thus constructed will be described with reference to FIG. 2.

When the key switch A is turned on to connect the turn-on terminal ON, the components in the control circuit 11 are supplied with electric power, and the preheating timer $T_1$ is actuated to turn on the main relay 5 only. Since one of the terminals of each of the glow plugs 1 through 4 is grounded at this time, the glow plugs 1 through 4 are connected in parallel to the battery B which supply a large current to these glow plugs 1 through 4 to heat them quickly. Upon elapse of the energization time $t_1$ of the preheating timer $T_1$, thereafter, the preheating timer $T_1$ turns off the main relay 5 to complete the quick heating of the glow plugs 1–4. At the same time, the output from the inverter INT goes high to thereby detect the de-energization of the main relay 5. During this time, the voltage comparator circuit composed of the voltage comparators $V_{C1}$, $V_{C2}$ and the AND gate $AND_1$ produces an output signal of a logic low level (which is the same as the output from the AND gate $AND_1$). When the delay pulse generator 14 issues a pulse signal for a short period of time upon elapse of the time interval after the preheating timer $T_1$ has been turned off, the changeover relay 7 is forcibly turned on to close the normally open contact 10 thereof with the time delay $\tau$, whereupon the glow plugs 1, 3 are connected in series with each other and the glow plugs 2, 4 are connected in series with each other. The glow plugs are then supplied with a small current from the battery B. The AND gate $AND_1$ then issues an output signal of a high logic level unless any of the glow plugs is subjected to wire breakage or disconnection as described later on. The output signal from the AND gate $AND_1$ continues to be high after the pulse signal from the delay pulse generator 14 has been eliminated, and the apparatus now enter a warmth retaining mode. This warmth retaining condition continues while the start terminal ST of the key switch A is turned on. The outputs from the voltage comparators $VC_1$, $VC_2$ and the delay pulse generator 14 are effective in carrying out changeover operation with the time delay $\tau$, and hence can change over the normally closed contact of the transfer relay while no current is being passed. Therefore, the normally closed contact of the transfer relay has an improved degree of durability.

When the key switch A is shifted from the start terminal ST to the turn-on terminal ON after the engine has been started, the warmth retaining timer $T_3$ is turned off. Since at this time the signal at the engine regulator L terminal 13 is already high in level because the engine has started, the afterglow timer $T_2$ is turned on, and the OR gate $OR_1$ continues to produce its high output signal. As long as the comparators $V_{C1}$, $V_{C2}$ issues high output signals, the changeover relay 7 remains actuated to allow the small current to flow through the series-connected glow plugs 1, 3 and 2, 4. The apparatus is in the afterglow mode to stabilize engine rotation and reduce the exhaust smoke immediately after the engine has been started until the time set by the afterglow timer $T_2$ elapses. The operation time of the afterglow timer $T_2$ may be controlled by a signal from a sensor for detecting the temperature of engine cooling water.

While the glow plugs 1, 3 and 2, 4 are connected in series and supplied with the small current, the comparator $V_{C1}$ detects the intermediate junction voltage $V_C$ and compares the same with the predetermined voltage $V_1$. If any one of the glow plugs 3, 4 is disconnected or cut off due to wire breakage, or the power supply voltage is increased up to an undue level, then the glow plugs 3, 4 are subjected to an excessive voltage. The comparator $V_{C1}$ then detects such an excessive voltage to turn off the changeover relay 7 forcibly, thereby preventing the remaining glow plugs from being overheated or disconnected due to wire breakage. Thus, the comparator $V_{C1}$ serves as a protective circuit for the glow plugs. The comparator $V_{C2}$ detects when the intermediate junction voltage $V_C$ is below the voltage $V_2$ having a predetermined ratio to the power supply voltage $V_D$, for example, a ratio of $(V_D \times \frac{1}{2} - \alpha)$ for a four-cylinder engine. More specifically, where the glow plugs 1, 2, 3, 4 have equal resistance characteristics $R_G$, the intermedinate junction voltage $V_C$ when both the glow plugs 1, 2 are in normal operation is expressed by:

$$V_C = \frac{1/2R_G}{R_G} \times V_D = 1/2 \times V_D$$

When one of the glow plugs 1 undergoes a wire breakage, hte intermediate junction voltage $V_C$ is expressed as follows:

$$V_C = \frac{1/2R_G}{3/2R_G} \times V_D = 1/3 \times V_D$$

Thus, the intermediate junction voltage becomes lower than when the glow plugs are normally operated. The comparator $V_{C2}$ detects such a voltage drop to turn off the changeover relay 7 forcibly. Accordingly, the comparator $V_{C2}$ also serves as a protective circuit for protecting the remaining glow plugs against overheating or wire breakage due to an excessive voltage applied. The problem of turning off the changeover relay 7 due to a reduction of the voltage $V_C$ caused by engine cranking or a voltage drop in the battery B is avoided by detecting the power supply voltage $V_D$ and using a reference voltage derived from the power supply voltage $V_D$ at a voltage division ratio corresponding to the ratio of a voltage drop at the time of wire breakage of the glow plugs.

Figure 2:
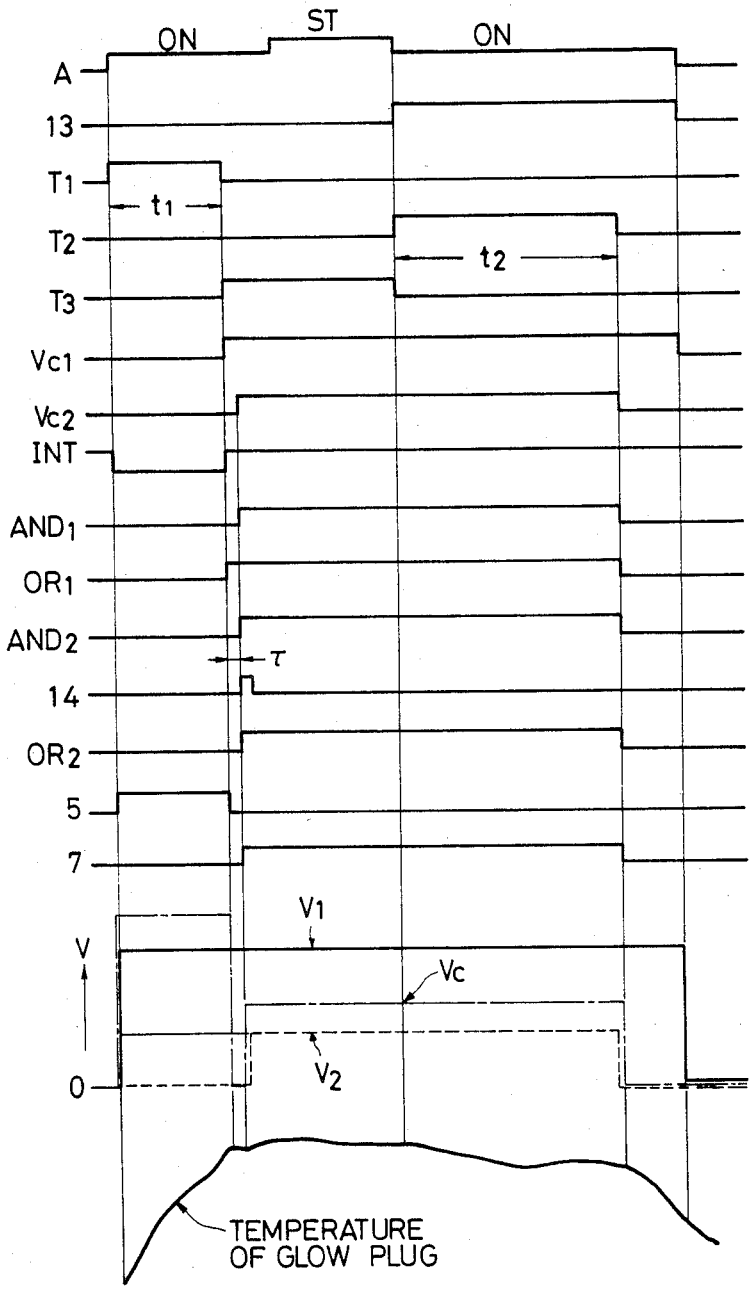
FIG. 2 is a timing chart showing operation of the apparatus illustrated in FIG. 1.

The comparators $V_{C1}$, $V_{C2}$ issue high output signals as long as the glow plug voltage or intermediate junction voltage $V_C$ has a normal value between the voltage settings $V_1$, $V_2$ as shown in FIG. 2.

With the arrangement of the present invention, as described above, the apparatus for controlling energization of quick-heating glow plugs in a diesel engine includes a main relay having a normally open contact through which a plurality of pairs of glow plugs with one terminals interconnected in each pair are connected to a power supply. One of the other terminals of the glow plugs in each pair is connected to ground, while the other one is connected to a neutral terminal of a transfer-type changeover relay having a normally closed contact connected to ground. The changeover relay has a normally open contact connected to the power supply. The glow plugs are selectively connected in series with or parallel to each other with respect to the power supply under the control of a control circuit for the main and changeover relays. The control apparatus is highly efficient in that it is free of wasteful power consumption which would otherwise results from the use of a conventional current limiting resistor in combination with the glow plugs. The control apparatus can therefore increase the useful service life of the battery used for powering the glow plugs and provide an afterglow effect for a long period of time.

The glow plugs are connected to the power supply through the normally open relay contact (the glow plugs are normally disconnected from the power supply). The glow plugs can be selectively connected in series or parallel through the control of energization of the changeover relay by a minimum number of relay contacts thereof. Accordingly, the control apparatus is reliable in operation, compact in size, and highly durable in operation. The apparatus is inexpensive to construct where glow plugs with both terminals insulated and glow plugs with one terminals grounded are employed in combination.

Although a certain preferred embodiment has been shown and described, it should be understood that many changes and modifications may be made therein without departing from the scope of the appended claims.

What is claimed is:

1. An apparatus for controlling energization of quick-heating glow plugs in a diesel engine, comprising:

(a) a power supply;

(b) a main relay having a normally open contact;

(c) a transfer-type changeover relay having a neutral terminal, a normally closed terminal connected to ground, and a normally open contact connected to said power supply;

(d) a plurality of pairs of glow plugs, said glow plugs each having one terminal connected through the normally open contact of said main relay to said power supply, said glow plugs in each pair having one of other terminals grounded and the other terminal in each pair connected to said neutral terminal of said transfer-changeover relay; and (e) a control circuit for controlling said main and changeover relays to connect said glow plugs in each pair selectively in series or parallel to each other with respect to said power supply.

2. An apparatus according to claim 1, wherein one of said glow plugs in each pair has both terminals insulated and the other glow plug in each pair has one terminal grounded.

3. An apparatus according to claim 1, wherein said control circuit includes a delayed-changeover control circuit for switching said changeover relay while no electric current is passed upon elapse of a short period of time after said main relay has been turned off, whereby the normally closed contact of said changeover relay can be increased in durability.

4. An apparatus according to claim 3, wherein said control circuit includes a preheating timer for determining a period of time in which said glow plugs in each pair are connected in parallel, a delay pulse generator for generating a pulse with a time delay after the time set by said preheating timer has elapsed, and a voltage comparator circuit for comparing a voltage level at said one terminal of said glow plugs with reference voltage levels and issuing an output only when said voltage level at said one terminal of each of said glow plugs falls within a voltage range between said reference voltage levels, to thereby protect said glow plugs from being subjected to wire breakage, said voltage comparator circuit and said delay pulse generator jointly constituting said delayed-changeover circuit.

* * * * *